US010938097B2

(12) United States Patent
Hovmoller

(10) Patent No.: US 10,938,097 B2
(45) Date of Patent: Mar. 2, 2021

(54) PCB ANTENNA

(71) Applicant: Axis AB, Lund (SE)

(72) Inventor: Henrik Hovmoller, Holbaek (DK)

(73) Assignee: Axis AB, Lund (SE)

( * ) Notice: Subject to any disclaimer, the term of this patent is extended or adjusted under 35 U.S.C. 154(b) by 68 days.

(21) Appl. No.: 15/629,415

(22) Filed: Jun. 21, 2017

(65) Prior Publication Data

US 2017/0365919 A1 Dec. 21, 2017

(30) Foreign Application Priority Data

Jun. 21, 2016 (EP) ..... 16175439

(51) Int. Cl.

| | |
|---|---|
| ***H01Q 1/22*** | (2006.01) |
| ***H01Q 1/38*** | (2006.01) |
| ***H01Q 1/48*** | (2006.01) |
| ***H01Q 5/371*** | (2015.01) |
| ***H01Q 5/30*** | (2015.01) |
| ***H01Q 5/40*** | (2015.01) |
| ***H01Q 9/42*** | (2006.01) |
| ***H01Q 13/10*** | (2006.01) |

(52) U.S. Cl.

CPC ..... *H01Q 1/38* (2013.01); *H01Q 1/22* (2013.01); *H01Q 1/2291* (2013.01); *H01Q 1/48* (2013.01); *H01Q 5/30* (2015.01); *H01Q 5/371* (2015.01); *H01Q 5/40* (2015.01); *H01Q 9/42* (2013.01); *H01Q 13/10* (2013.01)

(58) Field of Classification Search

CPC ..... H01Q 1/243; H01Q 1/22–1/48; H01Q 5/364–5/371; H01Q 5/30–5/40

USPC ..... 343/702, 846

See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 7,825,863 | B2 * | 11/2010 | Martiskainen | H01Q 1/243 343/700 MS |
| 7,990,320 | B2 * | 8/2011 | Pros | H01Q 1/243 343/700 MS |
| 9,379,432 | B2 * | 6/2016 | Ishikawa | H01Q 21/28 |
| 9,455,492 | B2 * | 9/2016 | Jiang | H01Q 1/243 |
| 2002/0145567 | A1 | 10/2002 | Spiegel et al. | |

(Continued)

FOREIGN PATENT DOCUMENTS

| | | |
|---|---|---|
| CN | 201489565 U | 5/2010 |
| CN | 103928757 A | 7/2014 |

(Continued)

OTHER PUBLICATIONS

European Search Report dated Dec. 16, 2016 in European Application 16175439.5 filed Jun. 21, 2016 (with Written Opinion).

(Continued)

*Primary Examiner* — Hasan Z Islam

(74) *Attorney, Agent, or Firm* — Oblon, McClelland, Maier & Neustadt, L.L.P.

(57) ABSTRACT

An antenna (200) comprises an antenna body (212). The antenna body is integrally formed as a part of a PCB (210) and the antenna body is enclosed by metal. The antenna body may be enclosed by printed or plated metal on both top and bottom surfaces of the PCB and by edge plated metal along the circumference of the antenna body.

6 Claims, 4 Drawing Sheets

(56) References Cited

U.S. PATENT DOCUMENTS

| | | | | |
|---|---|---|---|---|
| 2003/0063030 | A1* | 4/2003 | Stoiljkovic | H01Q 1/24 343/700 MS |
| 2004/0207557 | A1* | 10/2004 | Chen | H01Q 1/243 343/702 |
| 2005/0110692 | A1 | 5/2005 | Andersson | |
| 2008/0018543 | A1* | 1/2008 | Baliarda | H01Q 1/243 343/702 |
| 2008/0316116 | A1* | 12/2008 | Hobson | H01Q 9/0421 343/702 |
| 2011/0122043 | A1* | 5/2011 | Ridgeway | H01Q 1/243 343/860 |
| 2011/0279330 | A1* | 11/2011 | Huynh | H01Q 1/243 343/702 |
| 2012/0306700 | A1* | 12/2012 | Ridgeway | H01Q 1/2291 343/700 MS |
| 2013/0285857 | A1* | 10/2013 | Schultz | H01Q 21/24 343/700 MS |
| 2015/0138033 | A1* | 5/2015 | Su | H01Q 1/526 343/841 |
| 2015/0200448 | A1 | 7/2015 | Tsai et al. | |
| 2015/0263430 | A1 | 9/2015 | Lin et al. | |
| 2019/0081388 | A1* | 3/2019 | Lo Hine Tong | H01Q 7/00 |

FOREIGN PATENT DOCUMENTS

| | | | |
|---|---|---|---|
| CN | 104934707 | A | 9/2015 |
| CN | 105048079 | A | 11/2015 |
| JP | 2006-18421 | | 1/2006 |
| KR | 10-2008-0111362 | | 12/2008 |
| KR | 10-2010-0028892 | | 3/2010 |
| KR | 10-2010-0032681 | | 3/2010 |
| KR | 10-2011-0084930 | A | 7/2011 |
| TW | 200423476 | A | 11/2004 |
| WO | WO 03/077360 | A1 | 9/2003 |

OTHER PUBLICATIONS

European Office Action dated May 22, 2019 in Patent Application No. 16 175 439.5, 6 pages.

Nathan, J. et al., "PCB-Based Prototyping of 3-D Micromachined RF Subsystems", IEEE Transactions on Antennas and Propagation, XP011536450, vol. 62, No. 1, Jan. 1, 2014, pp. 420-429.

Office Action dated Nov. 29, 2019 in Korean Patent Application No. 10-2017-0077944, 8 pages (with English translation).

Chinese Office Action dated Apr. 14, 2020 in counterpart Chinese Patent Application No. 201710442283.9, (7 pages).

Japanese Office Action with English translation dated Mar. 5, 2020 in counterpart Japanese Patent Application No. 2017-121496, (10 pages).

Combined Chinese Office Action and Search Report dated Sep. 8, 2020 in Chinese Patent Application No. 201710442283.9, 7 pages.

* cited by examiner

PCB ANTENNA

TECHNICAL FIELD

Embodiments herein relate to antennas arranged on a Printed Circuit Board, PCB. Further they relate to a PCB, a transceiver and a wireless data acquisition device comprising the antenna.

BACKGROUND

An antenna is an electrical device which converts electric power into radio waves, and vice versa. It is usually used with a radio frequency (RF) transceiver comprising a transmitter and a receiver. Antennas are essential components for all equipment that uses wireless communication. They are used in systems such as radio and television broadcasting, two-way radio, communications receivers, radar, cell phones, satellite communications such as Global Position System (GPS), Wireless Speaker & Audio (WISA) system, Zigbee or Z-wave system and Wireless Local Area Network (WLAN), as well as other wireless communication devices such as wireless microphones, Bluetooth-enabled devices, wireless computer networks, baby monitors, RF identification (RFID) tags on products, wireless data acquisition devices such as cameras, Physical Access Control System (PACS) controllers such as garage door openers, building door controllers, network video recorders, home automation devices, data loggers etc.

There are various types of antennas and a selection of antenna may depend on different applications, available PCB size, cost, RF range and directivity. For example, for 2-10 GHz applications, the following types of antenna are widely employed:

Wire antenna: This is a piece of wire extending over a PCB in free space with its length matched to $\lambda/4$ over a ground plane. The wire antenna provides good performance and RF range because of its dimensions and three-dimensional exposure. The wire can be a straight wire, helix, or loop. This is a three-dimensional (3D) structure, with the antenna over a height of 4-5 mm over the PCB plane, protruding into space.

PCB Antenna: This is a trace or strip drawn on the PCB. This can be a straight trace, inverted F-type trace, meandered trace, circular trace, or a curve with wiggles depending on the antenna type and space constraints. In a PCB antenna, the antenna becomes a two-dimensional (2D) structure in the same plane as the PCB. A PCB antenna requires more PCB area and has a lower efficiency than the wire antenna. It is cheaper and easy to manufacture and it has a wireless range acceptable for, e.g., Bluetooth Low energy (BLE) application. However, a problem with such type of antenna is that the PCB material becomes part of the antenna. Different PCB material and different PCB thickness will have different relative permittivity ($\varepsilon_r$) which will influence radiation efficiency of the antenna due to different dielectric loss in the PCB. Therefore, if the material and thickness of the PCB is changed, the design and tuning of the antenna have to be changed.

A solution to such problem has been suggested in CN103928757, wherein an antenna 100 is arranged at edges of a PCB 110 and connected to a microcontroller unit (MCU) 120 on the PCB, as shown in FIG. 1. The antenna 100 is formed by mutually connecting top-layer printed copper 101, edge plated copper 102 and bottom-layer printed copper 103 together. In this way, all parts of the antenna on the top layer, the edge and the bottom layer of the PCB can have excellent signals and the directionality of the PCB antenna is thus improved. However, the PCB 110 remains as integral parts of the antenna 100 and thus influences the RF properties of the antenna 100.

WO 03/077360 discloses an antenna device comprising a flat ground substrate, a flat main radiating element having a radio signal feeding point, and a flat parasitic element. Preferably, said ground substrate, main radiating element and parasitic element are formed of a single sheet of electrically conductive material, and in one embodiment they are etched out from a metal layer on a printed circuit board. In one embodiment, said ground substrate is formed on one layer of a printed circuit board, whereas said main radiating element and said parasitic element are formed on another layer on said printed circuit board. The ground substrate and the antenna may be substantially located in the same plane.

US 2002/145567 discloses an antenna structure formed by molding a plateable plastic antenna element in the desired shape. The molded antenna element is plated substantially entirely thereabout with a conductive metal material. The antenna assembly includes the molded and plated antenna structure attached to a dielectric base structure adapted for mounting on an appropriate support such as a printed circuit board. A contact spring clip is interengaged between the antenna structure and the circuit board.

US 2015/263430 discloses an antenna structure including a ground plane and a grounding extension branch. The ground plane has a slot. The grounding extension branch is disposed in the slot, and is coupled to the ground plane. The antenna structure may further include a dielectric substrate, such as an FR4 (Flame Retardant 4) substrate, a system circuit board, or an FPCB (Flexible Printed Circuit Board). The ground plane and the slot of the antenna structure are formed on a surface of the dielectric substrate.

SUMMARY

In light of above it is an object of embodiments herein to provide a PCB antenna with improved performance.

According to one aspect of embodiments herein, the object is achieved by an antenna which comprises an antenna body. The antenna body is integrally formed as a part of a PCB and the antenna body is enclosed by metal.

In some embodiments, the antenna body may be enclosed by plated or printed metal on both top and bottom surfaces of the PCB and by edge plated metal along the circumference of the antenna body.

In some embodiments, the antenna body may extend out from an edge of the PCB. Alternatively, the antenna body may be surrounded by PCB material with an air gap between the majority of the circumference of the antenna body and the surrounding PCB.

Noting that the PCB material which forms the antenna body is enclosed or surrounded by metal, it will therefore not influence the properties of the antenna. Instead, the antenna body is essentially turned into a metal body. Further, the antenna body may be arranged to extend out from an edge of the PCB, or be arranged inside the edge of the PCB but with an air gap between the majority of the circumference of the antenna body and the surrounding PCB. In such examples, the antenna body is essentially isolated from other parts of the PCB and the surrounding PCB. Therefore the other parts of the PCB and the surrounding PCB will not influence the RF properties of the antenna.

Since an antenna according to embodiments herein is integrally formed as a part of the PCB, it may be conveniently and directly connected to other components on the same PCB by metal traces without extra parts or components. Further, an antenna according to embodiments herein can achieve the same advantage of a wire antenna, i.e. very good performance and RF range, since the antenna body is effectively a solid metal part by being enclosed in metal, and therefore forms a three-dimensional 3D structure and can achieve three-dimensional exposure to free space. At the same time, it overcomes the disadvantage of the wire antenna by being integrated as part of a PCB, having fewer parts and taking less space and vertical height. A reason for this is that the wire antenna or any other attached, separate antenna is an added part and needs an extra part to attach to the PCB. In addition, the design parameters of the antenna according to embodiments herein, e.g., the metal trace width and length, do not need to be tuned or changed and may be applied for various PCBs with different thickness and relative dielectric constant. Moreover, no extra manufacturing process is needed to make an antenna according to the embodiments herein, which means no extra cost.

Thus, the PCB antenna according to embodiments herein has improved performance, is small, cost efficient and uninfluenced by PCB properties. The design of the antenna is robust and accurate, and can be applied to various PCBs without adjustments.

According to other aspects of embodiments herein, the object is achieved by a PCB, a transceiver and a wireless data acquisition device which comprises an antenna. The antenna comprises an antenna body integrally formed as a part of the PCB, and the antenna body is enclosed by metal.

BRIEF DESCRIPTION OF THE DRAWINGS

Examples of embodiments will be described in more detail with reference to attached drawings in which.

DETAILED DESCRIPTION

Figure 1:
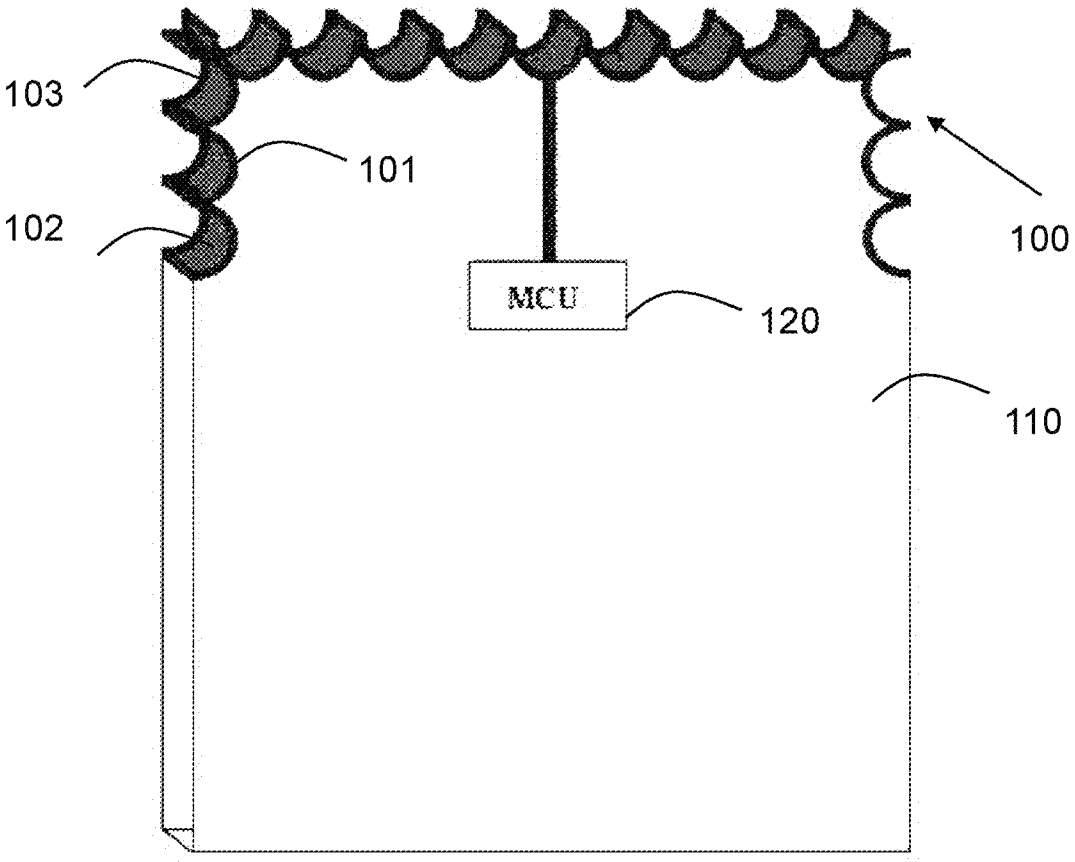
Fig. 1 Prior art
FIG. 1 is a PCB antenna according to prior art.
Figure 2B:
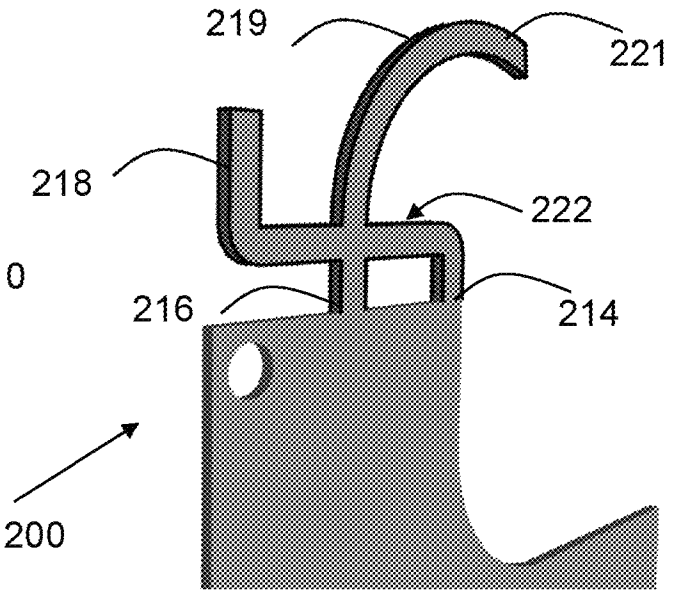
FIG. 2*b* is a schematic perspective view of a part of the PCB with the antenna shown in FIG. 2*a;*
Figure 2A:
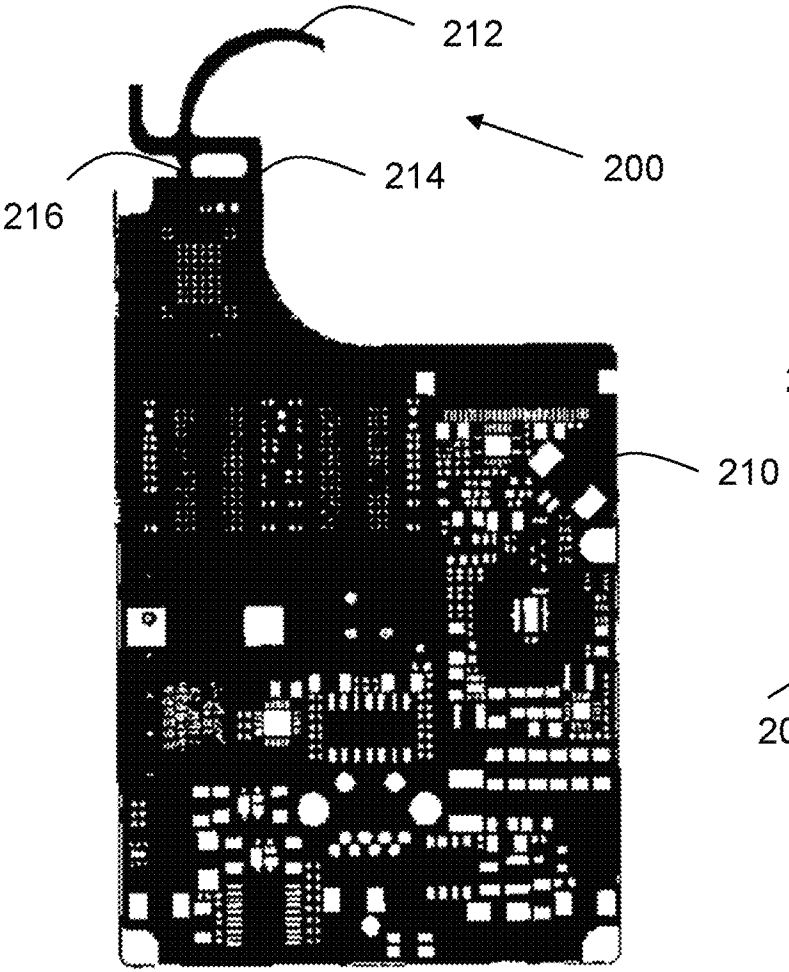
FIG. 2*a* is a top view of a PCB with an antenna according to embodiments herein.

FIG. 2*a* is a top view of a PCB 210, where one example embodiment of a PCB antenna 200 is shown. The PCB antenna 200 comprises an antenna body 212 integrally formed as a part of the PCB 210. In this example, the antenna 200 is designed to be a dual band antenna for 2.4 GHz and 5 GHz. The antenna body 212 has an F-shape extending approximately 16 mm out from the edge of the remaining PCB and being about 22 mm across. It should be noted that with another design and choice of shape, the antenna will have other dimensions. The antenna body 212 is cut out from the PCB along a majority of its circumference except at two ends 214, 216, where it extends from the rest of PCB 210. The antenna body 212 is enclosed in or embedded by metal, e.g., copper. This may be done using various processes. According to some embodiments herein, the antenna body 212 is enclosed by plated or printed metal on both top and bottom surfaces of the PCB 210 and by edge plated metal along the circumference of the antenna body 212.

FIG. 2*b* shows a perspective view of the antenna body 212. Typically there is already a printed or plated metal layer or metal traces on the top and bottom surface of the PCB, so both top and bottom surfaces 221, 222 of the antenna body 212 are covered by metal. When cutting out the antenna body 212, the cutting edge of the antenna body 212 is exposed to air. To enclose the antenna body 212, the cutting edge of the antenna body 212 may be edge plated by metal, e.g., copper. As shown in FIG. 2*b*, the edge of the antenna body 212 is plated by metal along the circumference of the antenna body which is separate from the PCB, where the edge marked with 218, 219 is visible. Edge plating the antenna body is a normal process that is done when, e.g., edge plating a via-hole. When the cutting edge is closed by edge plated metal, the antenna body 212 is enclosed by metal. This essentially turns the antenna body 212 into a solid metal part, even though it is integral with the rest of the PCB 210. Therefore, the antenna body 212 becomes a three-dimensional (3D) structure and can achieve three-dimensional exposure to free space, similar to a wire antenna, which means it may have great performance and RF range.

Further, in this embodiment, the antenna body 212 extends out from an edge of the PCB 210, as shown in FIGS. 2*a* and 2*b*. This has the advantage of providing free space around the antenna body.

Figure 3:
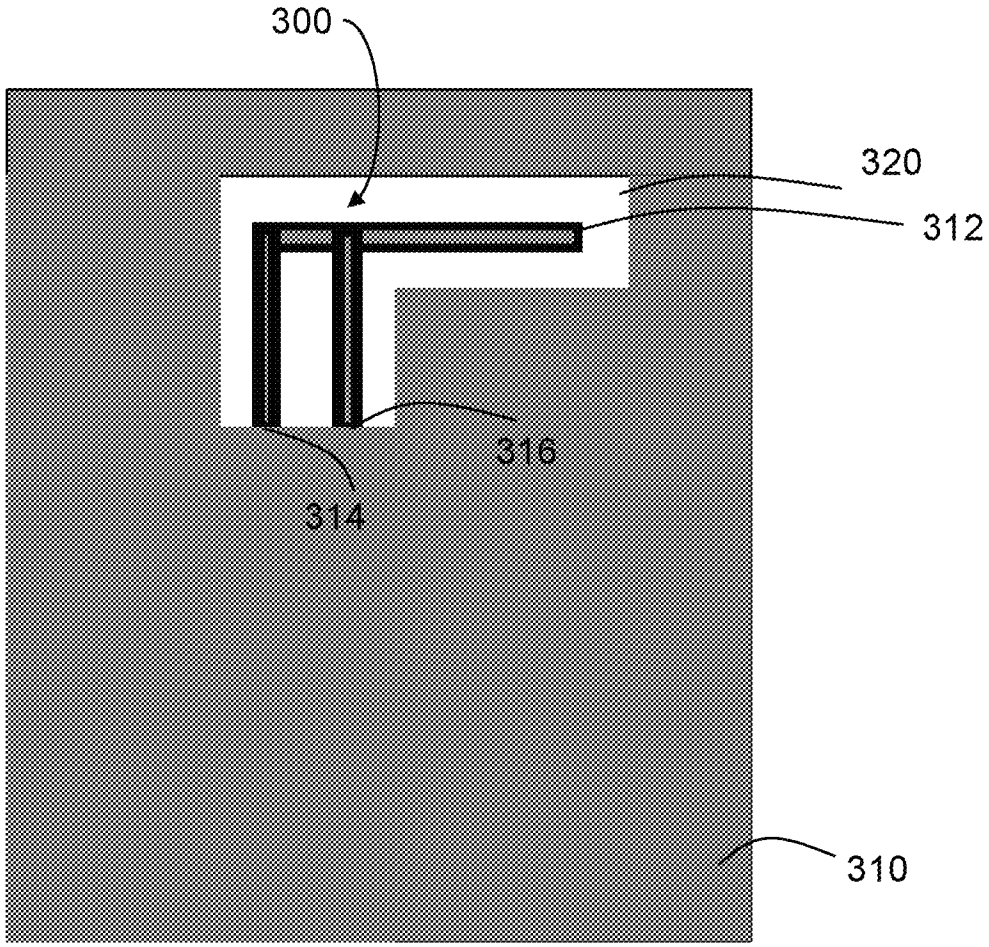
FIG. 3 is a schematic view illustrating a PCB antenna according to embodiments herein.

To save space and use available PCB area efficiently, according to some embodiments herein, the antenna body may be arranged on a PCB 310 as shown in FIG. 3. A PCB antenna 300 comprises an antenna body 312. The antenna body 312 is surrounded by PCB material with an air gap 320 between the majority of the circumference of the antenna body 312 and the surrounding PCB 310. The antenna body 312 extends from the rest of the PCB 310 at ends 314, 316. In this way, the antenna body 312 forms a "peninsula" in the PCB 310 with a "moat" around it, and the antenna body 312 is essentially isolated from the rest of PCB 310 and the surrounding PCB 310. Therefore the rest of and the surrounding PCB will not influence the RF properties of the antenna 300. The antenna body 312 is enclosed by metal in the same way as for the antenna body 212 described above and illustrated in FIGS. 2*a* and 2*b*. In this embodiment, the antenna body 312 has an inverted F-shape. On the surrounding PCB, some components may be located so that available PCB area is used efficiently. Further, since the antenna body 312 is located inside the PCB and does not extend out from the PCB 310, no extra space is needed for the antenna 300.

Although the antenna bodies 212, 312 in the two example embodiments have an F-shape and inverted F-shape, the antenna body 212, 312 may be configured to have any kind of shape depending on the type of antenna and space constraints, such as a straight line shape, an L-shape, a meander shape, a meandered inverted F-shape, a circular shape, a curve with wiggles shape, etc.

The design parameters, e.g., the metal width on the top and bottom surfaces of the antenna body 212, 312, the antenna length, the antenna feed connection etc., which determine the antenna radiation impedance, frequency selectivity, bandwidth and centre frequency, will require the same considerations as a conventional PCB antenna with respective shapes as mentioned above. However, the design of the antenna 200, 300 according to embodiments herein does not need to be tuned or changed and may be applied for various PCBs with different thickness and relative dielectric constant since the antenna body 212, 312 is enclosed by metal and isolated from the rest of PCB. That is, the design considerations are the same as for the normal PCB antenna, but without having to take the varying properties of the PCB material into account.

Since the antenna 200, 300 according to embodiments herein is integrally formed as a part of the PCB 210, 310, it may be conveniently and directly connected to other components on the PCB 210, 310, such as feeding port, transmission line, impedance matching network, antenna switch, filter, etc. on the same PCB by metal trace, e.g., by the same metal trace on the surface or bottom of the antenna body 212, 312, with no need for extra parts or components. It is also easy to impedance match to target impedance. For a transceiver, the target impedance may, e.g., be 50Ω.

The antenna 200, 300 according to embodiments herein may be configured for any one of Bluetooth, BLE, GPS, WISA, Zigbee, Z-wave and WLAN applications, and suitable for 2-10 GHz radio operation frequency.

Figure 4:
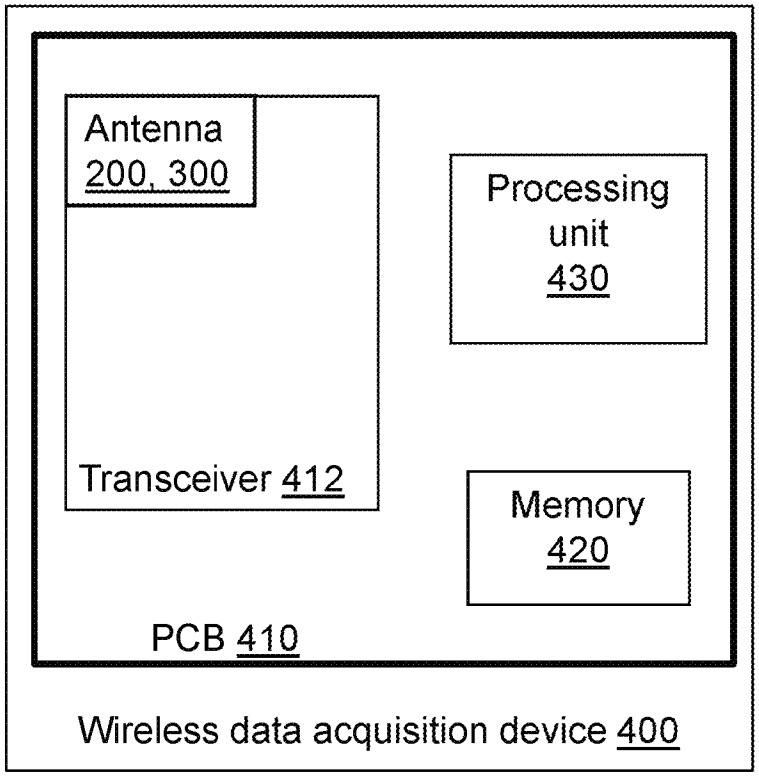
FIG. 4 is a block diagram illustrating a wireless data acquisition device in which an antenna according to embodiments herein may be implemented.

The antenna 200, 300 according to embodiments herein is suitable for any wireless communication device, or for any electronic device which needs an antenna. FIG. 4 shows a wireless data acquisition device 400 in which the antenna 200, 300 according to embodiments herein may be implemented. The wireless data acquisition device 400 may be any one of a camera, such as a monitoring camera, a PACS controller, a network video recorder, a home automation device, a data logger etc. The wireless data acquisition device 400 comprises a PCB 410, a transceiver 412 which uses the antenna 200, 300 according to embodiments herein. The wireless data acquisition device 400 may comprise other units, e.g., a memory 420 and a processing unit 430 for information storage and signal processing etc. The memory 420 and processing unit 430 may be located on the same PCB 410 as the antenna 200, 300.

To summarise, some advantages of the antenna 200, 300 according to embodiments herein include:

First, the PCB material which forms the antenna body 212, 312 is completely enclosed or surrounded by the metal and therefore will not influence the properties of the antenna.

Second, the antenna body 212, 312 is essentially isolated from the rest part of PCB and the surrounding PCB, therefore the rest part of the PCB and the surrounding PCB will not influence the properties of the antenna.

Third, the antenna 200, 300 may be conveniently and directly connected to other components on the same PCB by metal trace without extra parts or components.

Fourth, the antenna 200, 300 according to embodiments herein can achieve great performance and RF range.

Fifth, the antenna 200, 300 according to embodiments herein uses fewer parts, takes less space and vertical height.

Sixth, the antenna 200, 300 according to embodiments herein does not need to be adjusted or changed and may be applied for various PCBs with different thickness and relative dielectric constant.

Further, no extra manufacturing process is needed to make the antenna 200, 300 according to the embodiments herein, which means no extra cost.

When using the word "comprise" or "comprising" it shall be interpreted as non-limiting, i.e. meaning "consist at least of".

The embodiments herein are not limited to the above described preferred embodiments. Various alternatives, modifications and equivalents may be used. Therefore, the above embodiments should not be taken as limiting the scope of the invention, which is defined by the appending claims.

The invention claimed is:

1. An antenna, comprising:

a Printed Circuit Board (PCB) comprising at least one layer of dielectric substrate and a metal material, an antenna body integrally formed as a part of the PCB in that the antenna body is cut out along a majority of its circumference from the PCB, wherein top and bottom surfaces of the antenna body are covered by plated metal, and a cutting edge of the antenna body has metal edge plating along the circumference of the antenna body such that the antenna body is a three-dimensional metal structure, wherein the antenna body is separated from the PCB except where the antenna body extends out from an edge of the PCB and the PCB has additional components mounted thereon for direct electrical connection to the antenna body, wherein the antenna body has an F-shape and is surrounded by the metal material with an air gap between a majority of the circumference of the antenna body and the surrounding metal material, such that the antenna body is isolated from the surrounding metal material of the PCB, and wherein the antenna is configured for dual band operation in 2 GHz-10 GHz frequencies.

2. The antenna according to claim 1, wherein the antenna is configured for any one of Bluetooth, Bluetooth Low Energy, Global Position System, Wireless Speaker & Audio, Zigbee, Z-wave, and Wireless Local Area Network applications.

3. A device comprising the antenna according to claim 1.

4. A transceiver comprising the antenna according to claim 1.

5. A wireless data acquisition device comprising the transceiver according to claim 4.

6. The wireless data acquisition device according to claim 5, further comprising any one of a camera, a Physical Access Control System, a controller, a network video recorder, a home automation device, and a data logger.

* * * * *